United States Patent [19]

Kobayashi et al.

[11] Patent Number: 4,481,152

[45] Date of Patent: Nov. 6, 1984

[54] ROTARY THROTTLE VALVE CARBURETOR

[75] Inventors: Hiroto Kobayashi; Takeshi Kobayashi, both of Kawasaki, Japan

[73] Assignee: Walbro Far East, Inc., Kawasaki, Japan

[21] Appl. No.: 447,224

[22] Filed: Dec. 6, 1982

[30] Foreign Application Priority Data

Dec. 10, 1981 [JP] Japan ..... 56-197709

[51] Int. Cl.[3] ..... F02M 9/08

[52] U.S. Cl. ..... 261/35; 261/44 A; 261/44 G; 261/DIG. 68

[58] Field of Search ..... 261/44 G, 44 A, DIG. 68, 261/35

[56] References Cited

U.S. PATENT DOCUMENTS 1,782,848 11/1930 Gravely ..... 261/44 G 2,578,857 12/1951 Sumpter et al. ..... 261/44 G 4,271,096 6/1981 Kobayashi ..... 261/44 G

*Primary Examiner*—Tim Miles

*Attorney, Agent, or Firm*—Barnes, Kisselle, Raisch, Choate, Whittemore & Hulbert

[57] ABSTRACT

A rotary throttle carburetor in which an air passage leading to the engine has a crossbore to receive a cylindrical rotary throttle having a throttle passage to regulate the air passage. A constant pressure device is mounted on the carburetor body directly below the rotary throttle and a short straight fuel passage connects a constant pressure chamber of said device with the throttle passage of the rotary valve. A fuel pump device can be mounted between the carburetor body and the constant pressure device to supply fuel to the constant pressure chamber and also to insulate the constant pressure device from the carburetor body to reduce vaporization.

2 Claims, 1 Drawing Figure

ROTARY THROTTLE VALVE CARBURETOR

FIELD OF INVENTION

This invention relates to a rotary throttle valve carburetor to be used on a two-cycle engine, which can provide a power source for chain saws and weed cutters and the like.

BACKGROUND OF INVENTION

In a rotary throttle valve carburetor, fuel flows into the throttle passage of a rotary throttle valve through a nozzle tube, which is supported on the carburetor body at one end of the rotary throttle valve.

Generally, the rotary throttle valve carburetor is provided with a diaphragm device in between a fuel pump and the nozzle tube for supplying a prescribed amount of fuel to the nozzle tube regardless of the carburetor position.

However, in the prior art, with this type of carburetor, the diaphragm device is incorporated into the carburetor body in a position outwardly of the circumference of the rotary throttle valve. Therefore, the fuel passage leading to the nozzle tube from the constant pressure chamber in the diaphragm device is comparatively long in length. The reason for this is that the passage is extended from the constant pressure chamber around the end of the carburetor body to the nozzle tube which is located parallel with the circumference and in the direction of the axis of the rotary throttle valve. The passage is then joined at a 90° angle to the nozzle tube.

For the purpose of promoting efficient engine response, and coordinating with the throttle valve opening, it is advantageous to locate the fuel guide passage directly between the nozzle tube and the constant pressure chamber.

Further, it is desirous that atomized fuel vapor or an air and fuel mixture in the constant pressure chamber be quickly discharged from the throttle chamber through the fuel passage. In the prior art, the design is such that there is a possibility of the fuel vapor being trapped in the angle of the fuel passage. This trapped vapor interferes with the operating efficiency of the engine since the vapor prevents the prescribed amount of fuel flow from reaching the engine.

Accordingly, it is an object of this invention to design a rotary throttle valve carburetor that can achieve engine response according to the throttle valve setting as well as improve the efficiency of the engine.

A feature of this invention is to promote engine efficiency and response by locating the diaphragm device with the constant pressure chamber at the exterior of the carburetor body adjacent the end of the rotary throttle valve where the nozzle tube passes into the throttle passage. This results in the fuel passage from the constant pressure chamber to the nozzle tube being essentially straight and also shortens the length of the passage.

Additional features of this invention will be apparent in the following description and claims taken in connection with the accompanying figure illustrating, by way of example, a preferred embodiment of this invention.

BRIEF DESCRIPTION OF THE DRAWING

A drawing accompanies the disclosure and the single FIGURE can be described as follows:

Referring now to FIG. 1, the carburetor 10 of this invention comprises a carburetor body 16 having an air hole 12 with a crossbore 14, one end of which is closed. A cylindrical rotary throttle valve 18 is rotatable in the bore 14 and shiftable along its rotating axis. One end **12*a* of the air hole 12, as has been well known, communicates with an air and fuel intake of an internal combustion engine, for instance, a two-cycle engine, while the other end 12*b*** communicates with an air inlet which may have an air cleaner (not shown).

Figure 1:
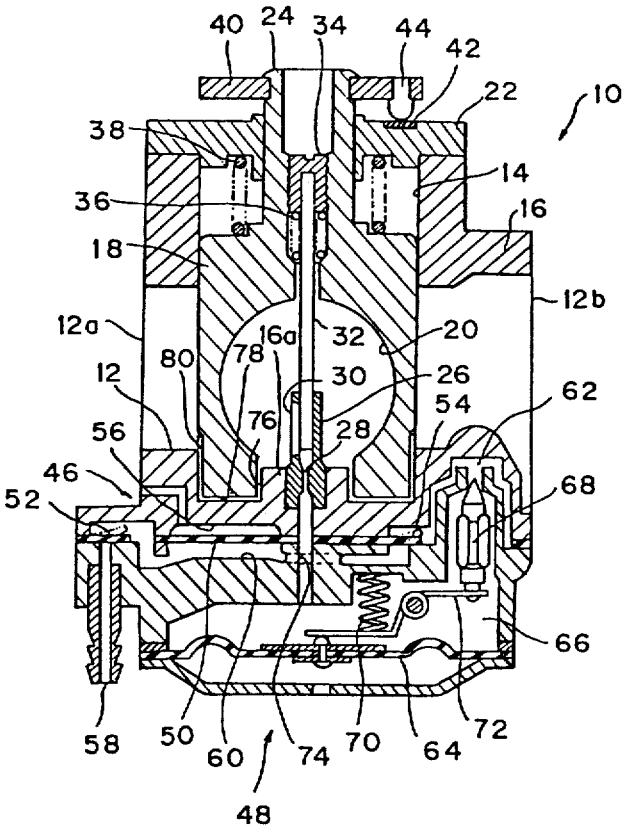
FIG. 1, a vertical sectional view of the carburetor of this invention.

The throttle valve 18 is provided with a transverse throttle passage 20 which is rotatably adjustable with respect to the air hole 12. An extension 24 passes through the cover 22 which closes the top of the bore 14. At the bottom of the bore 14 an open ended nozzle tube 26 is located. The tube 26 is extended into the throttle passage 20 of the valve through the bottom end of the throttle valve 18. The nozzle tube 26, as has been well known, is located in the carburetor body 16 on the axis of rotation of the throttle valve. The nozzle tube 26 is provided with an orifice 28 adjacent a nozzle hole 30 which opens on the circumference of the tube 26 into the throttle passage 20.

Mounted in the throttle valve 18 is a needle 32 which projects from the extension 24 to the throttle passage 20 along the axis of rotation. The point of the needle enters the tube 26 from one open end. As has been well known, needle 32 is adjustably positioned along the axis by way of a screw 34 in extension 24. Loosening of the screw 34, by vibration or other reasons, can be prevented by the spring 36. The throttle valve 18 has a coil spring 38 arranged between the valve and the cover 22 to urge the valve 18 against the bottom of the hole 14.

An operating lever 40 is fastened to the top of the extension 24 of the throttle valve 18. A cam follower 44 on lever 40 works against a cam face 42 on the reverse side of the cover 22. Rotation on the control lever 40, by action of the cam face and the cam follower 44 connected therewith, will lift up the throttle lever 18 and the needle 36 which is mounted on the valve 18. This will overcome the spring force of the coil spring 38 and move the throttle valve 18 along its axis. Therefore, by operating the control lever 40 and rotating of the throttle valve 18, the throttle passage 20 is regulated as to its effectiae diameter relative to the air hole 12. Also, the tip of the needle 32, in response to rotation of the throttle valve 18, is moved back and forth in the nozzle tube 26. By doing so, the effective diameter of the nozzle tube 30 can be increased or decreased so as to stay at the most proper value in relation to the effective diameter of the throttle passage 20.

A fuel pump 46 for delivering fuel from a fuel tank (not shown), and a diaphragm device 48 for retaining fuel flow delivered by the pump, are respectively incorporated into the carburetor body 16.

The fuel pump 46 is arranged close to the bottom wall of the bore 14 of the carburetor body 16. Fuel pump 46 consists of a diaphragm 50 and a pair of check valves 52 and 54 at each side of diaphragm 50. Directly below the throttle valve 18 and above diaphragm 50 is a diaphragm chamber 56. Operating pulse pressure from the crankcase of, for example, a two-cycle engine, is introduced into the chamber 56 while the engine is operating, and fuel is sucked into the pump chamber 60 on the lower side of diaphragm 50 through the opening 58 and one check valve 52. Fuel in the pump chamber 60 will be transmitted by pressure to the diaphragm device 48 through the other check valve 54 and through the passage 62 which extends to the diaphragm device 48.

The diaphragm device 48 is provided with a diaphragm 64 which is arranged at a right angle to the rotating axis of the throttle valve 18.

Diaphragm 64 governs the constant pressure chamber 66 which receives fuel from pump 46 through a passage 62. A valve 68 is arranged to control the passage 62. A swing lever 72 resisted by a spring 70 is connected to the diaphragm 64 and to the valve 68. Directly below the throttle valve 18 and the nozzle tube 26, the constant pressure chamber 66 is located and a short straight passage 74 connects the nozzle and the chamber 66. Fuel will be sucked into the throttle passage 20 from the chamber 66 by the negative pressure acting through nozzle orifice 30. Accordingly, fuel is supplied to the constant pressure chamber 66 from the fuel pump 46 and is retained in a prescribed amount in the constant pressure chamber 66.

The constant pressure chamber 66 communicates with the bottom end of the nozzle tube 28 through the fuel passage 74 positioned on the axis of rotation of the throttle valve 18. The fuel passage 74 is comparatively short and straight and the upper end opens at the nozzle tube 28.

As has been described, the best desired amount of fuel can properly and quickly be supplied to the nozzle tube 26 from the constant pressure chamber 66 by negative pressure in the throttle hole 20 and the suction varies depending on the opening varation of the throttle valve 18.

In addition to the above, even atomized fuel in the constant pressure chamber 66 will soon be drawn into the throttle hole 20 through the straight fuel passage 74. Also, because the passage 74 is straight, in contrast to the prior art, no atomized fuel fume can be trapped in the fuel passage 74. Accordingly, fuel flowing in the guide passage 74 is not interrupted, as was the case in the prior art, because of air pockets, and the fuel flows smoothly in the fuel passage and thus promotes efficient engine operation.

As illustrated in FIG. 1, there is provided a by-pass for liquid fuel flowing from the throttle hole 20 to the engine through the following: The aperture 76 between the support 16*a* of the nozzle tube 26 and the end of the throttle valve 18; the aperture 78 between the bottom of the hole 14 and the end of the throttle valve; and the slot 80 built parallel to the axis of rotation at the end of the throttle valve 18, one end of which communicates with the said aperture 78 and the other end of which opens at the air hole 12. The described by-pass prevents fuel collecting at the bottom of the throttle hole 20 and prevents engine stoppage by an overrich fuel and air mixture reaching the engine upon opening of the throttle or tilting of the carburetor.

There has been described an example of an embodiment in which the fuel pump 46 is positioned between device 48 and the throttle valve 18. However, without this fuel pump 46, the diaphragm device 48 can be arranged even closer to the nozzle tube 26.

However, there is an advantage in disposing the pump 46 between the throttle valve 18 and the constant pressure device 48 since the constant pressure chamber 66 is further isolated from the heat of the engine and vaporization of the fuel in this chamber is thus minimized. The pump 46 is constructed with a single resilient diaphragm sheet 50 which provides the diaphragm action as well as forming the valves 52 and 54. This sheet extending across the carburetor housing provides an insulating barrier between the carburetor attached to the engine and the constant pressure device 48.

It is also possible to locate the fuel passage 74, inclined to the axis of rotation of the throttle valve but in a straight line. Nevertheless, the fuel passage should be made essentially straight with a low and smooth angle so as not to entrap atomized fuel in any air pocket.

The object of this invention, as described above, is to promote efficient engine response, and operating efficency, and to build a carburetor compact in size, by making the guide passage substantially straight to join with the nozzle tube located at the end of the throttle valve and close to the constant pressure chamber of the control diaphragm.

What is claimed is:

1. In a rotary throttle type carburetor in which a rotary throttle, movable from an idling position to an open throttle position, is positioned in a bore transverse to an air hole having an inlet and outlet in a carburetor body with a throttle passage registering with said air hole, that improvement which comprises a constant pressure device mounted on said carburetor body having a constant pressure chamber directly below said rotary throttle, and a short straight fuel passage connecting said constant pressure chamber and said throttle passage, a fuel pump device mounted on said carburetor body between said body and said constant pressure device, said fuel passage extending through said fuel pump device to said throttle passage.

2. In a rotary throttle type carburetor in which a rotary throttle, movable from an idling position to an open throttle position, is positioned in a bore transverse to an air hole having an inlet and outlet in a carburetor body with a throttle passage registering with said air hole, that improvement which comprises a constant pressure device mounted on said carburetor body having a constant pressure chamber directly below said rotary throttle, and a short straight fuel passage connecting said constant pressure chamber and said throttle passage, a fuel pump device mounted on said carburetor body between said body and said constant pressure device, said fuel passage extending through said fuel pump device to said throttle passage, and said fuel pump device including a resilient sheet forming a diaphragm and valve portions and extending across said carburetor body to provide a heat barrier between said carburetor body and said constant pressure device.

* * * * *